United States Patent [19]

Kavoussi

[11] Patent Number: 4,603,992

[45] Date of Patent: Aug. 5, 1986

[54] AEROSOL SHAVING BRUSH

[76] Inventor: James P. Kavoussi, 1401 80th St., Brooklyn, N.Y. 11228

[21] Appl. No.: 694,140

[22] Filed: Jan. 23, 1985

[51] Int. Cl.[4] ..... A46B 11/02

[52] U.S. Cl. ..... 401/190; 222/213; 401/272; 401/286

[58] Field of Search ..... 401/190, 272, 273, 286, 401/190, 270; 222/213

[56] References Cited

U.S. PATENT DOCUMENTS

| | | | |
|---|---|---|---|
| 2,638,613 | 5/1953 | Gunther | 401/272 |
| 2,849,737 | 9/1958 | Piccinini et al. | 401/190 X |
| 3,173,167 | 3/1965 | Kaufman | 401/190 |
| 3,302,235 | 2/1967 | Gerber | 401/190 |
| 3,343,201 | 9/1967 | Cox et al. | 401/190 |
| 3,345,673 | 10/1967 | Schwartzman | 401/273 X |
| 3,370,908 | 2/1968 | Cupp | 401/190 |
| 4,442,958 | 4/1984 | Amos | 272/213 |

FOREIGN PATENT DOCUMENTS

| | | | |
|---|---|---|---|
| 557160 | 12/1974 | Switzerland | 401/190 |

*Primary Examiner*—Steven A. Bratlie
*Attorney, Agent, or Firm*—Richard L. Miller

[57] ABSTRACT

An aerosol shaving brush attachment for a conventional aerosol shaving cream container that has a top rim and a shaving cream dispensing nozzle thereon is provided and consists of a housing that is removably mounted to the top rim of the container and can manually flex the nozzle in any direction to dispense shaving cream from the container into the interior of brush bristles secured to and projecting from top of the housing.

2 Claims, 3 Drawing Figures

AEROSOL SHAVING BRUSH

BACKGROUND OF THE INVENTION

The instant invention relates generally to shaving accessories and more specifically it relates to an aerosol shaving brush attachment.

Numerous shaving accessories have been provided in prior art that are adapted to aid in shaving a beard. While these prior art units may be suitable for the particular purpose to which they address, they would not be suitable for the purposes of the present invention as heretofore described.

SUMMARY OF THE INVENTION

A principle object of the present invention is to provide an aerosol shaving brush attachment that can be quickly attached to the top of a conventional aerosol shaving cream container so that the shaving cream can be dispensed into the brush bristles directly from the container when the container nozzle is activated.

Another object is to provide an aerosol shaving brush attachment that will completely cover the top of the conventional aerosol shaving cream container preventing dirt and dust from entering thus keeping the container nozzle in a sanitary condition.

An additional object is to provide an aerosol shaving brush attachment that has a flexible area thereon so that the attachment can flex to one side or the other to activate the vertically extending nozzle of the container to let shaving cream escape therefrom and enter into the interior of the brush bristles.

A further object is to provide an aerosol shaving brush attachment that is simple and easy to use.

A still further object is to provide an aerosol shaving brush attachment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
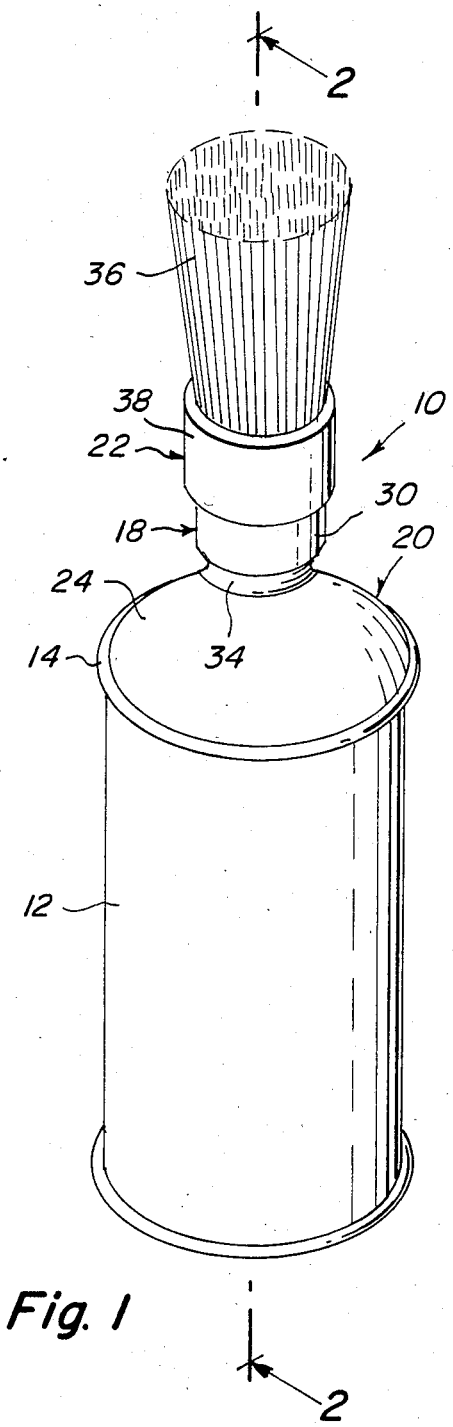
FIG. 1 is a perspective view of the instant invention on a pressurized shaving cream container.
Figure 2:
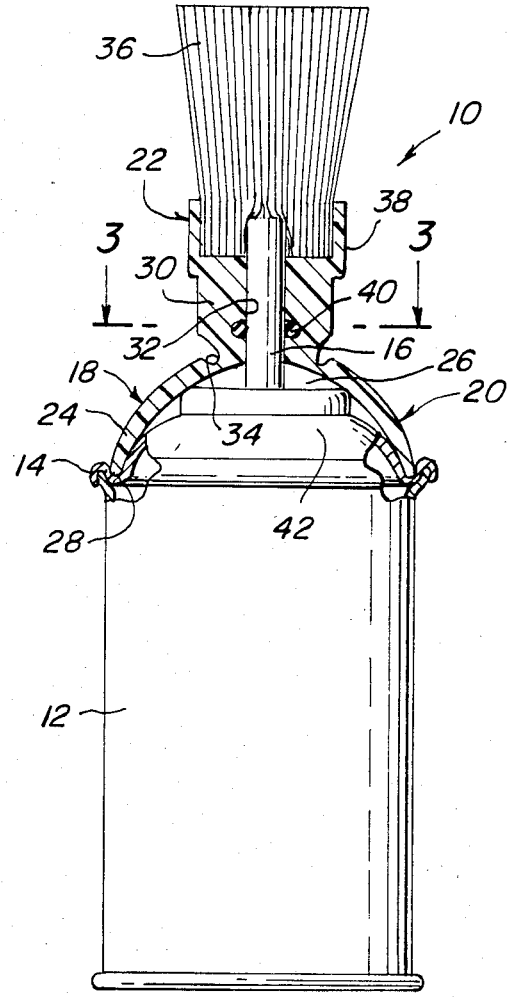
FIG. 2 is a cross sectional view of the invention taken on line 2—2 of FIG. 1.
Figure 3:
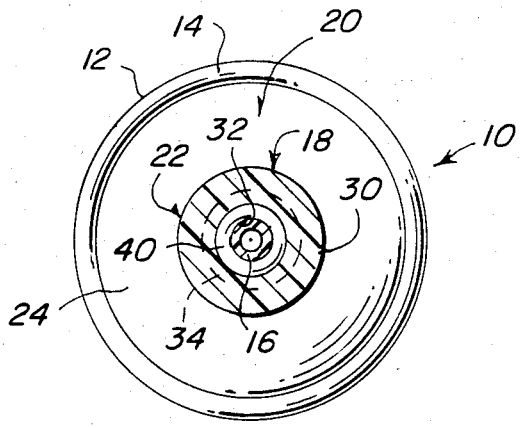
FIG. 3 is a cross sectional view taken on line 3—3 of FIG. 2.

Turning now descriptively to the drawings, in which similar reference characters denote similar elements throughout the several views, FIGS. 1 through 3 illustrates an aerosol shaving brush attachment 10 for a conventional aerosol shaving cream container 12 that has a top rim 14 and a shaving cream dispensing nozzle 16 thereon.

The attachment 10 contains a housing 18 that has a lower portion 20 and an upper portion 22. The lower portion 20 defines a dome-like member 24 that has a hollow chamber 26 therein. Edge 28 of the dome-like member 24 is proportioned to engage with the top rim 14 of the container 12 for removably mounting the housing 18 on the container 12. The upper portion 22 defines a cylindrical member 30 that has a vertical aperture 32 therethrough to receive the nozzle 16 of the container 12.

The cylindrical member 30 has a lower annular groove 34 at junction with the dome-like member 24 allowing the cylindrical member 30 to manually flex the nozzle 16 in any direction to dispense shaving cream from the container 12.

A plurality of brush bristles 36 are secured to and projecting from top 38 of the cylindrical member 30 and are adapted to receive the shaving cream from the nozzle 16 of the container 12 into the interior thereof.

An O-ring 40 is mounted within the cylindrical member 30 at the aperture 32 to surround the nozzle 16 to increase sealing capabilities of the housing 18. The hollow chamber 26 of the dome-like member 24 of the housing 18 completely covers top 42 of the container 12 preventing dirt and dust from entering thus keeping the nozzle 16 in a sanitary condition.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An aerosol shaving brush attachment for conventional aerosol shaving cream container having a top rim and a shaving cream dispensing nozzle therein, said attachment comprises:

(a) a housing having a lower portion and an upper portion, said lower portion defining a dome-like member having a hollow chamber therein with edge of said dome-like member being proportioned to engage and remain in complete contact with said top rim of said container for removably mounting said housing on said container, whereby said hollow chamber of said dome-like member of said housing completely covers the top of said container at all times during installation and use preventing dirt and dust from entering thus keeping said nozzle in a sanitary condition, said upper portion defining a complete cylindrical member having a vertical aperture therethrough to receive said nozzle of said container, said cylindrical member having a lower annular groove at the junction with said dome-like member allowing said cylindrical member to manually flex said nozzle in any angular direction to dispense shaving cream from said container while the dome-like member remains onto said top rim; and (b) a plurality of brush bristles secured to and projecting from the top of said cylindrical member adapted to receive said shaving cream from said nozzle of said container into interior of said brush bristles.

2. An aerosol shaving brush attachment as recited in claim 1 further comprising an O-ring mounted within said cylindrical member at said aperture to surround said nozzle to increase sealing capabilities of said housing.

* * * * *